US006538604B1

(12) United States Patent
Isohätälä et al.

(10) Patent No.: US 6,538,604 B1
(45) Date of Patent: Mar. 25, 2003

(54) PLANAR ANTENNA

(75) Inventors: Anne Isohätälä , Kello (FI); Suvi Tarvas, Oulu (FI); Petteri Annamaa, Oulunsalo (FI)

(73) Assignee: Filtronic LK Oy, Kemeple (FI)

( * ) Notice: Subject to any disclaimer, the term of this patent is extended or adjusted under 35 U.S.C. 154(b) by 0 days.

(21) Appl. No.: 09/703,971

(22) Filed: Nov. 1, 2000

(30) Foreign Application Priority Data

Nov. 1, 1999 (FI) ..... 19992356

(51) Int. Cl.[7] ..... H01Q 1/38; H01Q 1/24
(52) U.S. Cl. ..... 343/700 MS; 343/702
(58) Field of Search ..... 343/700 MS, 702; H01Q 1/38, 1/24

(56) References Cited

U.S. PATENT DOCUMENTS

| | | | | |
|---|---|---|---|---|
| 4,791,423 A | | 12/1988 | Yokoyama et al. | |
| 5,148,181 A | | 9/1992 | Yokoyama et al. | |
| 5,327,151 A | | 7/1994 | Egashira | |
| 5,519,406 A | * | 5/1996 | Tsukamoto et al. | 343/700 MS |
| 5,764,190 A | | 6/1998 | Murch et al. | 343/702 |
| 5,767,810 A | * | 6/1998 | Hagiwara et al. | 343/700 MS |
| 5,832,372 A | * | 11/1998 | Clelland et al. | 343/702 |
| 5,917,450 A | | 6/1999 | Tsunekawa et al. | |
| 5,926,150 A | | 7/1999 | McLean et al. | 343/846 |
| 6,218,992 B1 | * | 4/2001 | Sadler et al. | 343/702 |
| 6,222,496 B1 | * | 4/2001 | Liu | 343/846 |

FOREIGN PATENT DOCUMENTS

| | | | |
|---|---|---|---|
| DE | 1 024 552 A2 | 8/2000 | H01Q/21/30 |
| EP | 0 526 643 A1 | 8/1992 | H04B/1/18 |
| EP | 1 018 779 A2 | 7/2000 | H01Q/9/04 |

* cited by examiner

*Primary Examiner*—Hoanganh Le
(74) *Attorney, Agent, or Firm*—Darby & Darby

(57) ABSTRACT

The invention relates to an antenna structure (400) to be placed inside in particular small radio apparatus. A conventional PIFA-type structure is extended by arranging a structural part (415) adding to the capacitance between the radiating plane (420) and ground plane (410) relatively close to the feed point (F) of the antenna. The structural component may be a projection extending from the radiating plane towards the ground plane or vice versa. An advantage of the invention is that it achieves a significant increase in the antenna bandwidth without increasing the size of the antenna. Another advantage of the invention is that the structure according to it is simple and the increase in the manufacturing costs is relatively low.

6 Claims, 5 Drawing Sheets

PLANAR ANTENNA

CROSS-REFERENCE TO RELATED APPLICATION

This application claims priority from Finland Application No. 19992356, entitled "Planar Antenna," filed on Nov. 1, 2000, the disclosure of which is hereby incorporated by reference in its entirety.

BACKGROUND OF THE INVENTION

1. Field of the Invention

The invention relates in particular to a planar antenna structure installable inside small-sized radio apparatus.

2. Description of the Related Art

In portable radio apparatus it is very desirable that the antenna be placed inside the covers of the apparatus, for a protruding antenna is impractical. In modem mobile stations, for example, the internal antenna naturally has to be small in size. This requirement is further emphasized as mobile stations become smaller and smaller. Furthermore, in dual-band antennas the higher operating band at least should be relatively wide, especially if the apparatus in question is meant to function in more than one system utilizing the 1.7–2 GHz band.

When aiming at a small-sized antenna the most common solution is to use a PIFA (planar inverted F antenna). The performance of such an antenna functioning in a given frequency band or bands depends on its size: The bigger the size, the better the characteristics, and vice versa. For example, decreasing the height of a PIFA, i.e. bringing the radiating plane and ground plane closer to each other, markedly decreases the bandwidth and degrades the efficiency. Likewise, reducing the antenna in the directions of width and length by making the physical lengths of the elements smaller than their electrical lengths decreases the bandwidth and especially degrades the efficiency.

Figure 1:
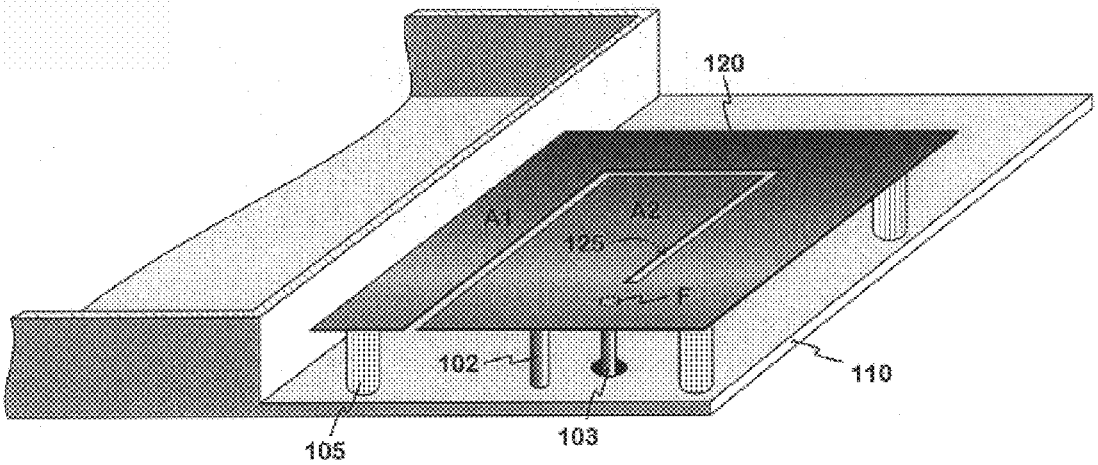
Fig. 1 PRIOR ART

FIG. 1 shows an example of a prior-art dual-band PIFA. In the Figure there can be seen the frame 110 of the apparatus in question which is drawn horizontal and which functions as the ground plane of the antenna. Above the ground plane there is a planar radiating element 120 which is supported by insulating pieces, such as 105. Between the radiating element and ground plane there is a short-circuit piece 102. The radiating element 120 is fed at a point F through a conductor 103 via a hole in the ground plane. In the radiating element there is a slot 125 which starts from the edge of the element and extends to near the feed point F after having made two rectangular turns. The slot divides the radiating element, viewed from the feed point F, into two branches A1 and A2 which have different lengths. The longer branch A1 comprises in this example the main part of the edge regions of the radiating element, and its resonance frequency falls on the lower operating band of the antenna. The shorter branch A2 comprises the middle region of the radiating element, and its resonance frequency falls on the upper operating band of the antenna. The disadvantage of structures like the one described in FIG. 1 is that the tendency towards smaller antennas for compact mobile stations may degrade the electrical characteristics of an antenna too much; the bandwidth of the higher resonance band may be insufficient, for example.

From the prior art it is not known solutions that would significantly increase the bandwidth of a PIFA without increasing the size of the antenna. From earlier applications it is known to the applicant a structure in which the bandwidth is increased by making the slot of the radiating element in two portions having a certain ratio of widths (FI 991807), as well as a structure in which the bandwidth is increased by adding above the radiating plane a second radiating plane and by placing dielectric material between these planes and on top of the uppermost plane (FI 992268).

SUMMARY OF THE INVENTION

Figure 2:
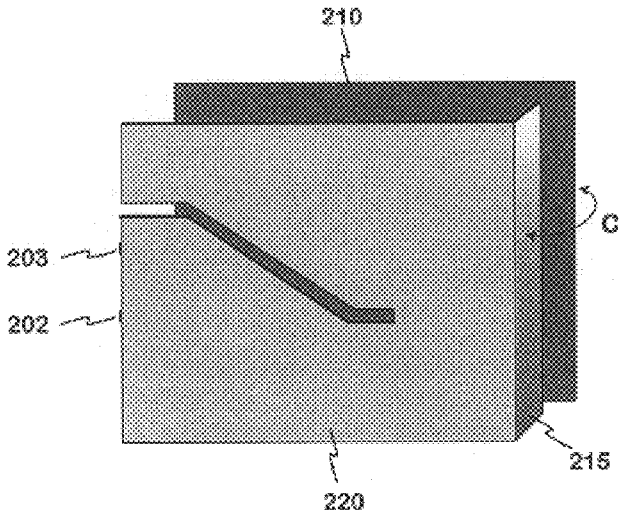
PRIOR ART Fig. 2
Figure 3:
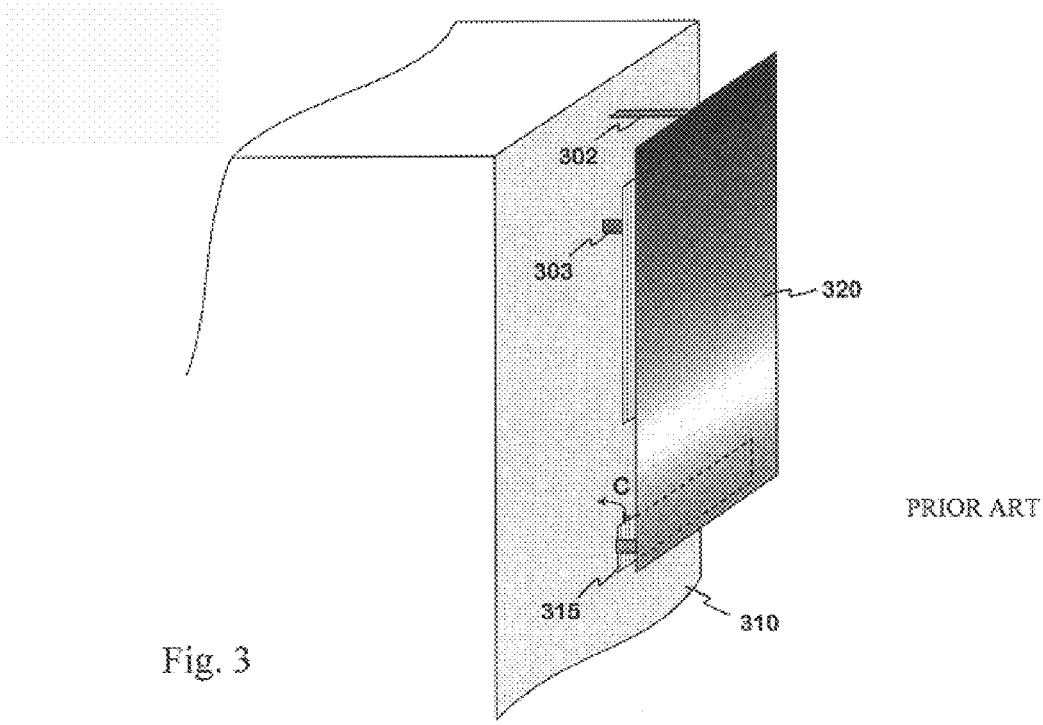

In the solution disclosed herein the bandwidth of a PIFA is increased by increasing in a certain area the capacitance between the ground plane and radiating plane by means of conductors. Such increasing of capacitance is known per se in the prior art. FIG. 2 shows a simplified example in which the radiating plane 220 has been bent at its edge towards the ground plane 210. Between the bend 215 and ground plane there is then a certain additional capacitance C. FIG. 3 shows a structure known from publication U.S. Pat. No. 5,764,190 where there is between the radiating plane 320 and ground plane 310 a relatively small parallel plane 315 in galvanic contact with the former to increase the capacitance. In these cases, the structural part increasing the capacitance is at the opposite end of the antenna in relation to the feed place determined by the feed conductor 203 (303) and short-circuit conductor 202 (302), and the purpose of the structural part is mainly to reduce the physical size of the antenna.

The object of the invention is to increase in a novel manner the bandwidth of a small-sized PIFA. A structure according to the invention is characterized by what is expressed in the independent claim 1. Some preferred embodiments of the invention are presented in other claims.

The basic idea of the invention is as follows: A conventional PIFA-type structure is extended by forming the structural part adding to the capacitance between the radiating plane and ground plane relatively close to the feed point of the antenna. The structural part may be a projection pointing from the radiating plane to the ground plane or vice versa.

An advantage of the invention is that it achieves a significant increase in the antenna bandwidth without increasing the size of the antenna. Another advantage of the invention is that the structure according to it is simple and the increase in the manufacturing cost is relatively low.

BRIEF DESCRIPTION OF THE ILLUSTRATIVE EMBODIMENTS

Figure 5:
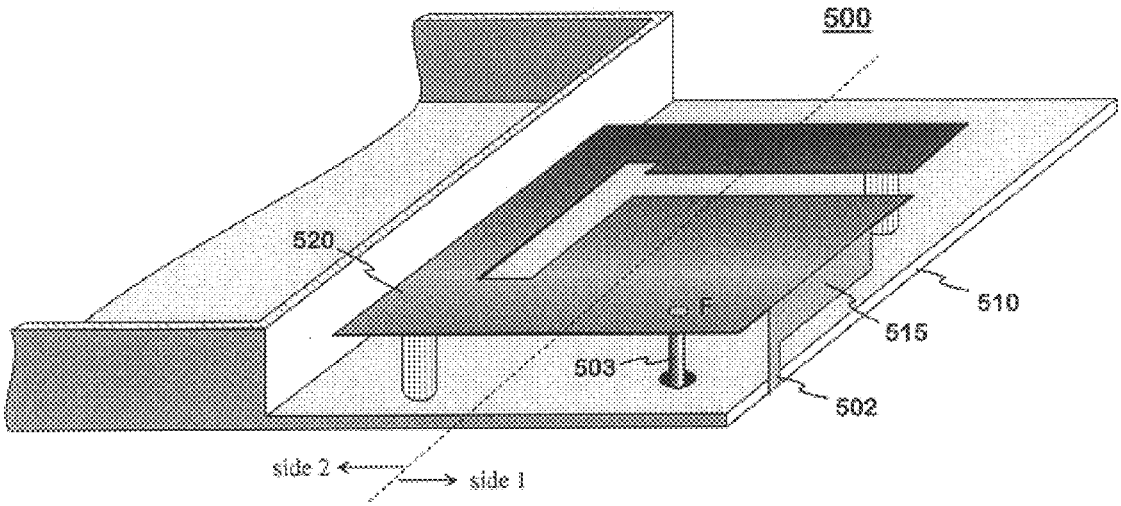
Figure 6:
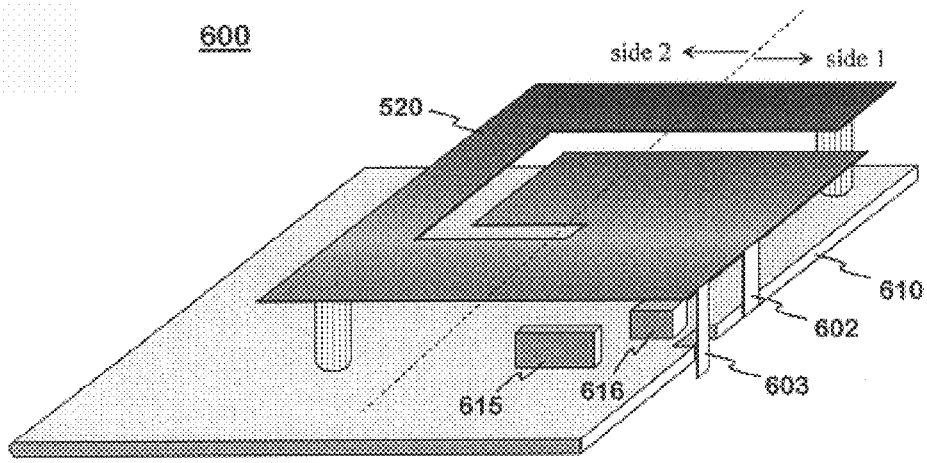
Figure 7:
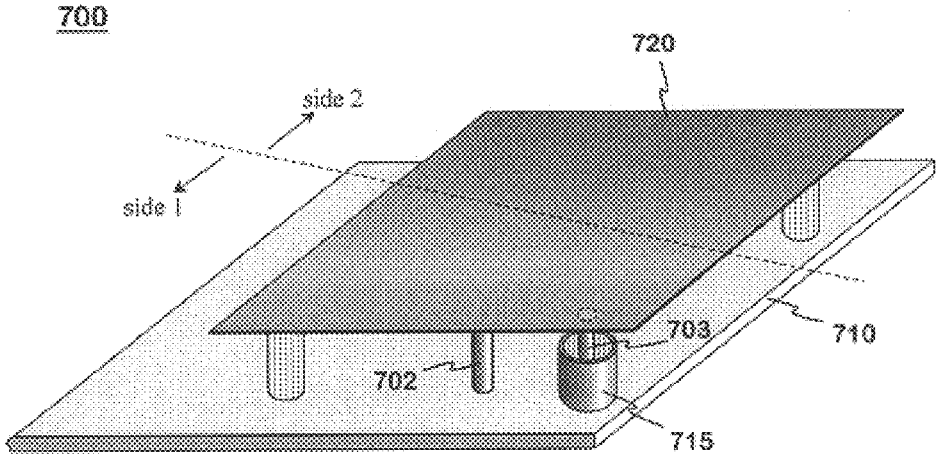
Figure 8:
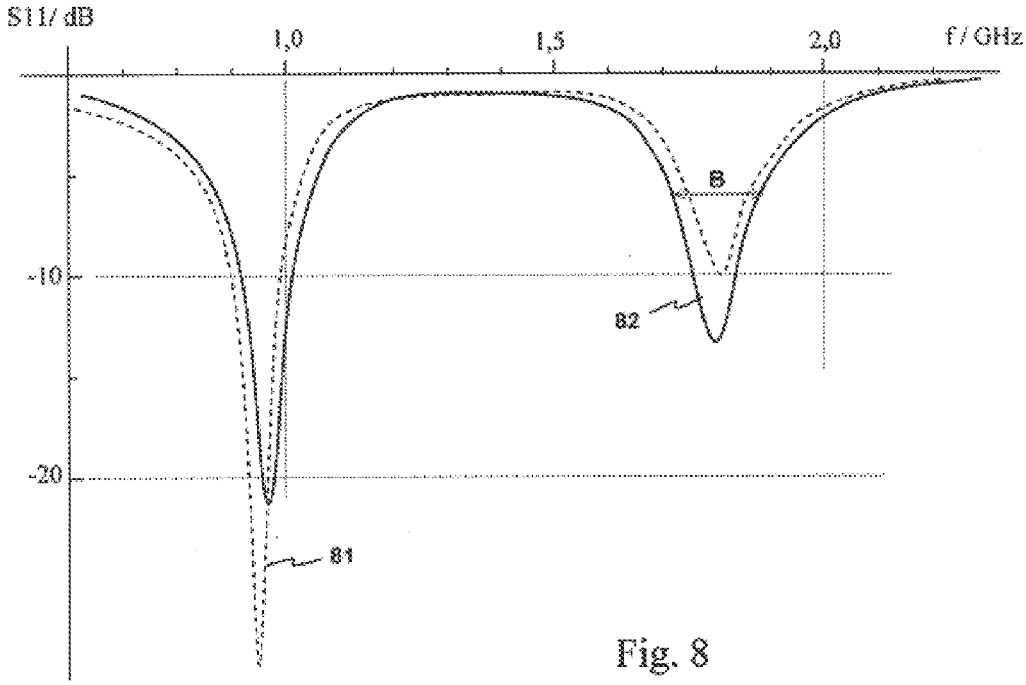
Figure 9:
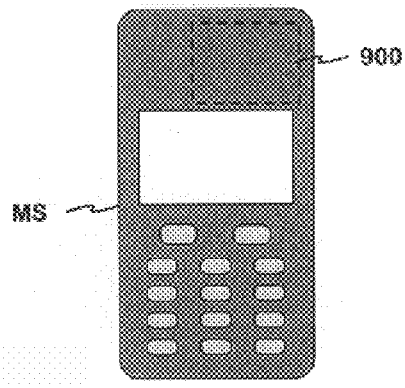

The invention is below described in detail. Reference will be made to the accompanying drawings in which FIG. 1 shows an example of a PIFA according to the prior art, FIG. 2 shows an example of a known structure intended to increase capacitance, FIG. 3 shows a second example of a known structure intended to increase capacitance, FIG. 4 shows an example of an antenna structure according to the invention, FIG. 5 shows a second embodiment of the invention, FIG. 6 shows a third embodiment of the invention, FIG. 7 shows a fourth embodiment of the invention, FIG. 8 shows an example of the characteristics of an antenna according to the invention, and FIG. 9 shows an example of a mobile station equipped with an antenna according to the invention.

DETAILED DESCRIPTION OF THE ILLUSTRATIVE EMBODIMENTS

FIGS. 1, 2 and 3 were already discussed in connection with the description of the prior art.

Figure 4:
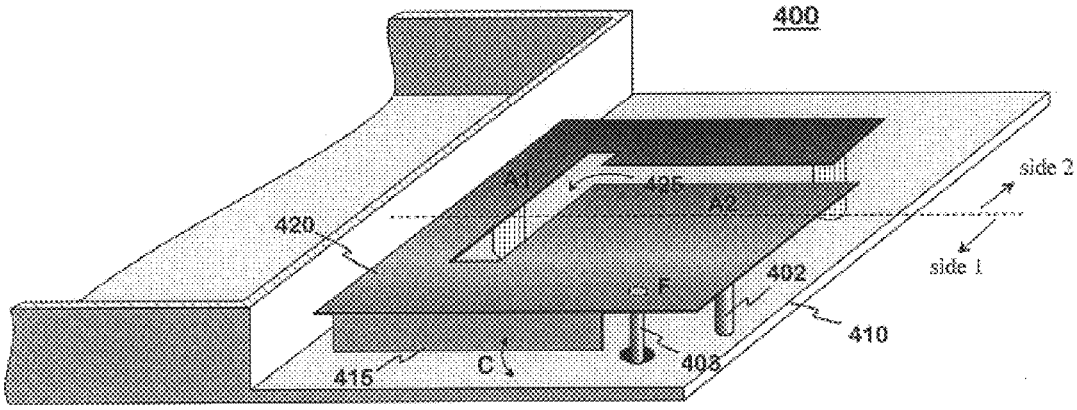

FIG. 4 shows an example of the antenna structure according to the invention. An antenna 400 comprises a ground plane 410 and radiating plane 420. A short-circuit conductor 402 and antenna feed conductor 403 are in this example joined to the radiating plane near a comer of this. The radiating plane has a slot 425 that divides it, viewed from the feed point F, into two branches A1 and A2 which have clearly unequal resonance frequencies. The example thus shows a dual-band structure. In accordance with the invention a conductive projection 415 towards the ground plane is joined to the radiating plane relatively near the feed point F. The projection 415 is formed e.g. by bending a projection originally formed on the plane 420 on the side facing the feed point into a right angle. Between the projection 415 and ground plane 410 there is a certain capacitance C. This effectively compensates for the inductive part of the antenna feed impedance, thus producing acceptable matching over a significantly wider frequency band than without said projection. The arrangement according to FIG. 4 can be used to widen the higher frequency band in particular, which indeed often needs to be done.

FIG. 5 shows a second example of the arrangement according to the invention. There is an antenna 500 comprising a ground plane 510, radiating plane 520, and a shortcircuit conductor 502 therebetween. In accordance with the invention there is joined to the radiating plane a conductive projection 515 pointing towards the ground plane. In this example the projection is in galvanic contact with the short-circuit conductor 502 such that the short-circuit conductor is very wide starting, as it were, from the radiating plane, and the lower end, i.e. the part connected to the ground plane, is relatively narrow. The projection 515 and short-circuit conductor 502 are formed e.g. by bending a projection originally formed on the plane 520 into a right angle. The arrangement according to FIG. 5 is advantageous especially when the area available for the radiator is relatively large. Extension of the short-circuit conductor decreases the resonance frequencies, which has to be compensated for by making the radiators longer, whereby they become narrower. This reduces the advantage of the structure with small antenna areas.

FIG. 6 shows a third example of the arrangement according to the invention. There is an antenna 600, comprising a ground plane 610, radiating plane 620 and a shortcircuit conductor 602 therebetween. In this example there are two conductive pieces adding to the capacitance between the planes, and they are located on the ground plane side: A first conductive piece 615 extends from the ground plane towards the radiating plane below the edge of the latter, relatively close to the feed conductor 603. Correspondingly, a second conductive piece 616 extends from the ground plane towards the radiating plane underneath the latter, closer to the feed conductor 603 than the first conductive piece.

FIG. 7 shows a fourth example of the arrangement according to the invention. There is an antenna 700, comprising a ground plane 701, radiating plane 720 and a short-circuit conductor 702 therebetween. In this example the antenna has got one operating band. The conductive piece 715 adding to the capacitance between the planes is now a hollow cylinder around that portion of the feed line 703 which is located between the ground plane and radiating plane, in galvanic contact with the ground plane. Thus, said conductive piece, apart from increasing the capacitance between the planes in the vicinity of the feed point, also reduces the inductiveness of the feed since it has got distributed capacitance with respect to the feed conductor. A piece corresponding to the cylinder 715 could as well be joined to the radiating plane and extend to a certain distance from the ground plane.

FIG. 8 shows curves of reflection coefficient S11 as a function of frequency, illustrating the effect of the invention on the bandwidths of a dual-band antenna. The result is valid for an exemplary structure according to FIG. 4. Curve 81 illustrates the change in the reflection coefficient of an antenna according to the prior art, and curve 82 the change in the reflection coefficient of a corresponding antenna according to the invention which has got an extension like the projection 415 in FIG. 4. Comparing the curves, one can see that especially the upper operating band, locating in the 1.8 GHz region becomes wider with the arrangement according to the invention. With a reflection coefficient value of −6 dB as a criterion for the band limit, the bandwidth B increases over 1.5-fold: Its relative value increases from a little under six per cent to a little over nine per cent. The lower operating band in the 900 MHz region also becomes somewhat wider.

FIG. 9 shows a mobile station MS. It has an antenna 900 according to the invention, which in this example is located entirely within the covers of the mobile station.

Above it was described antenna structures according to the invention. The invention does not limit the shape or quantity of the radiating element(s); for example, there may be on top of an element according to the invention another radiating element. Furthermore, the invention does not limit in any way the manufacturing method of the antenna. The inventional idea can be applied in different ways within the limits defined by the independent claim 1.

What is claimed is:

1. An antenna structure comprising a planar radiating element, a ground plane, a short circuit conductor there between, and a feed conductor for the radiating element, further comprising at least one of substantially planar or cylindrical conductive material increasing the capacitance between the radiating element and ground plane to broaden a bandwidth of the antenna structure, said conductive material joined to the antenna structure on a side halved by a fictional plane including the middle normal of the radiating element, said side shared by said short circuit conductor and said feed conductor.

2. The structure of claim 1, characterized in that said conductive material forms a part (415) of the radiating element (420), oriented towards the ground plane (410) and located relatively close to feed point F of said radiating element.

3. The structure of claim 1, characterized in that said conductive material (515) accompanies galvanically by said short-circuit conductor (502).

4. The structure of claim 1, characterized in that said conductive material forms at least one projection (615, 616) located relatively close to the feed conductor (603) of the radiating element (620) and extending from the ground plane (610) towards the radiating element.

5. The structure of claim 1, characterized in that said conductive material forms a piece (715) positioned around the feed conductor (703) of the radiating element (720).

6. A radio apparatus (MS) comprising an antenna (900) that comprising a planar radiating element and a ground plane, a short circuit conductor there between, and a feed conductor for the radiating element, said antenna further comprises at least one of substantially planar or cylindrical conductive material increasing the capacitance between the radiating element and the ground plane to broaden a bandwidth of the antenna structure, said conductive material joined to the antenna structure on a side halved by a fictional plane including the middle normal of the radiating element, said side shared by said short circuit conductor and feed conductor.

* * * * *